US009399976B2

(12) United States Patent
Ramamurthy et al.

(10) Patent No.: US 9,399,976 B2
(45) Date of Patent: Jul. 26, 2016

(54) FUEL DELIVERY SYSTEM CONTAINING HIGH PRESSURE PUMP WITH ISOLATION VALVES

(71) Applicants: DENSO International America, Inc., Southfield, MI (US); DENSO CORPORATION, Kariya-shi, Aichi-ken (JP)

(72) Inventors: Dhyana Ramamurthy, Novi, MI (US); Steve Roseborsky, Kingsville (CA)

(73) Assignees: Denso International America, Inc., Southfield, MI (US); DENSO CORPORATION, Kariya, Aichi-pref., (JP)

( * ) Notice: Subject to any disclaimer, the term of this patent is extended or adjusted under 35 U.S.C. 154(b) by 399 days.

(21) Appl. No.: 13/945,401

(22) Filed: Jul. 18, 2013

(65) Prior Publication Data

US 2015/0020776 A1 Jan. 22, 2015

(51) Int. Cl.
*F02M 55/04* (2006.01)
*F04B 1/04* (2006.01)
(Continued)

(52) U.S. Cl.
CPC ..... *F02M 55/04* (2013.01); *F02M 59/462* (2013.01); *F02M 63/005* (2013.01);
(Continued)

(58) Field of Classification Search
CPC ..... F02M 63/005; F02M 63/0285; F02M 37/0041; F02M 37/06; F02M 55/005; F02M 63/0245; F02M 69/54; F02M 63/029; F02M 55/04; F02M 59/462; F02M 21/0233; F02M 21/2042; F02M 21/0245; F02M 21/0293; F02M 35/10255; F02M 37/0023; F02M 37/04; F02M 37/041; F02M 37/043; F02M 37/045; F02M 37/08; F02M 2037/087; F02M 37/14; F02M 37/18; F02M 39/005; F02M 41/00; F02M 41/02; F02M 41/042; F02M 41/047; F02M 41/063; F02M 2041/1438; F02M 2041/1444; F02M 2041/1488; F02M 2041/1477; F02M 47/02; F02M 47/022; F02M 47/025; F02M 47/027; F02M 59/022; F02M 59/025; F02M 59/205; F02M 59/36; F02M 59/361; F02M 59/46; F02M 59/366; F02M 59/464; F02M 59/466; F02M 59/02; F02M 63/0012; F02M 63/0054; F02M 69/142; F02M 2001/009; F02M 1/10; F02D 41/3863; F02D 2250/04; F02D 2250/31; F02D 2275/14; F02D 2001/009; F02D 1/10; F04B 49/08; F04B 27/0456; F04B 27/1009; F04B 37/12; F04B 39/1006; F04B 39/1046; F04B 49/002; F04B 49/24
USPC ..... 123/446, 456, 495, 179.17, 445, 506, 123/510, 458, 459, 511, 457, 460; 417/442, 417/504, 303, 559, 302, 304; 137/87.01
See application file for complete search history.

(56) References Cited

U.S. PATENT DOCUMENTS 4,367,638 A * 1/1983 Gray ..... F04C 28/04 418/15
4,382,748 A * 5/1983 Vanderlaan ..... F04B 49/007 417/11

(Continued)

FOREIGN PATENT DOCUMENTS

JP 2003278624 10/2003
JP 2010133265 6/2010

*Primary Examiner* — Hung Q Nguyen
*Assistant Examiner* — John Bailey
(74) *Attorney, Agent, or Firm* — Harnes, Dickey & Pierce, P.L.C.

(57) ABSTRACT

A fuel delivery system including a high pressure fuel pump assembly. The assembly includes first and second output fuel paths each in communication with a fuel pump chamber. A main pressure relief fuel path is in communication with the fuel pump chamber and includes a pressure relief valve. A first relief fuel path is in communication with both the first output fuel path and the main pressure relief fuel path. A second relief fuel path is in communication with both the second output fuel path and the main pressure relief fuel path. The first and the second relief fuel paths are configured to restrict fuel flow therethrough between the first and the second output fuel paths.

20 Claims, 7 Drawing Sheets

(51) Int. Cl.

| | |
|---|---|
| ***F04B 53/10*** | (2006.01) |
| ***F04B 53/16*** | (2006.01) |
| ***F02M 63/02*** | (2006.01) |
| ***F02M 63/00*** | (2006.01) |
| ***F02M 59/46*** | (2006.01) |

(52) U.S. Cl.

CPC ..... *F02M 63/0265* (2013.01); *F02M 63/0295* (2013.01); *F04B 1/0404* (2013.01); *F04B 1/0452* (2013.01); *F04B 53/10* (2013.01); *F04B 53/16* (2013.01); *F02M 2200/315* (2013.01)

(56) References Cited

U.S. PATENT DOCUMENTS 4,448,168 A * 5/1984 Komada ..... F02M 59/105 123/446
4,583,509 A * 4/1986 Schechter ..... F02M 59/366 123/451
5,017,098 A * 5/1991 Hansen ..... F04C 14/26 417/302
5,121,730 A * 6/1992 Ausman ..... F02M 57/025 123/381
5,181,451 A * 1/1993 Geuns ..... E21D 23/18 417/303
5,191,867 A * 3/1993 Glassey ..... F02M 57/025 123/446
5,213,083 A * 5/1993 Glassey ..... F02M 57/025 123/179.17
5,245,970 A * 9/1993 Iwaszkiewicz ..... F02M 55/00 123/179.17
5,375,576 A * 12/1994 Ausman ..... F02M 59/105 123/446
5,515,829 A * 5/1996 Wear ..... F02B 75/22 123/446
5,839,413 A * 11/1998 Krause ..... F02M 57/025 123/179.17
5,878,718 A * 3/1999 Rembold ..... F02D 33/006 123/198 D
6,390,072 B1 * 5/2002 Breeden ..... F02M 59/105 123/495
6,467,457 B1 * 10/2002 Lei ..... F02M 55/004 123/456
7,789,068 B2 * 9/2010 Serra ..... F02D 41/3854 123/446
7,827,961 B2 * 11/2010 Cooke ..... F02M 43/02 123/446
7,945,989 B2 * 5/2011 Sepke ..... A47L 9/0483 137/87.07
8,136,507 B2 * 3/2012 Nagai ..... F02M 37/0023 123/468
8,251,046 B2 * 8/2012 Brown ..... F02M 31/20 123/445
8,257,067 B2 * 9/2012 Fukui ..... F02M 59/366 417/505
8,701,631 B2 * 4/2014 Oikawa ..... F02M 59/46 123/457
8,789,513 B2 * 7/2014 McCune ..... F02M 63/027 123/456
8,794,936 B2 * 8/2014 Tokuo ..... F02M 37/0047 417/442
2004/0159356 A1 * 8/2004 Vari ..... F15B 13/0814 137/596
2004/0207253 A1 * 10/2004 Nakayasu ..... B60T 8/363 303/113.5
2008/0154479 A1 * 6/2008 Graham ..... F02M 47/027 701/103
2009/0084355 A1 * 4/2009 Vogt ..... F02M 59/00 701/104
2010/0030451 A1 * 2/2010 Lippa ..... F02D 19/0684 701/104
2010/0101538 A1 * 4/2010 Beardmore ..... F02M 59/102 123/495
2011/0023832 A1 * 2/2011 Brown ..... F02M 31/20 123/456
2011/0106393 A1 * 5/2011 Pursifull ..... F02D 33/003 701/101
2011/0125387 A1 * 5/2011 Suzuki ..... F02D 41/126 701/103
2012/0195780 A1 * 8/2012 Matsumoto ..... F04B 1/0404 417/559
2013/0312404 A1 * 11/2013 Ganzel ..... F15B 15/00 60/533
2014/0216408 A1 * 8/2014 Nagao ..... F02D 41/3845 123/447
2014/0219848 A1 * 8/2014 Rabhi ..... F16C 33/306 418/24
2015/0034335 A1 * 2/2015 Brown ..... E21B 19/10 166/379

* cited by examiner

FUEL DELIVERY SYSTEM CONTAINING HIGH PRESSURE PUMP WITH ISOLATION VALVES

FIELD

The present disclosure relates to a high-pressure fuel pump with dual outlets.

BACKGROUND

This section provides background information related to the present disclosure, which is not necessarily prior art.

Fuel delivery systems of direct injected engines often include a high-pressure fuel pump for pumping fuel to a first fuel rail and a second fuel rail. The fuel rails deliver fuel to a plurality of fuel injectors associated therewith. The fuel rails are often connected to the high-pressure pump with a Y-block, or a cross-over line extending between the fuel rails so as to connect the fuel rails in "series." To attenuate fuel pulsations, orifices are added to fuel feed lines that deliver fuel to the fuel rails, and a pressure relief path to a fuel pump chamber is included. In spite of the orifices and the relief valve, fuel pulsations from one fuel rail often affect the pressure in the other fuel rail. For example, if a three lobe pump cam is used, there will be one pumping event for every two consecutive injection events (occurring on opposite fuel rails). This often leads to a pressure differential between the fuel rails, which is undesirable.

A fuel delivery system that provides pressure relief and isolates fuel rails from one another such that there is no pressure differential between them would therefore be desirable. This permits reduction in both fuel rail volume and pressure rise times. Isolating the fuel rails also reduces the number of joints between the high-pressure pump and the fuel rails, which simplifies assembly and reduces both assembly time and cost.

SUMMARY

This section provides a general summary of the disclosure, and is not a comprehensive disclosure of its full scope or all of its features.

The present teachings provide for a fuel delivery system including a high pressure fuel pump assembly. The assembly includes first and second output fuel paths each in communication with a fuel pump chamber. A main pressure relief fuel path is in communication with the fuel pump chamber and includes a pressure relief valve. A first relief fuel path is in communication with both the first output fuel path and the main pressure relief fuel path. A second relief fuel path is in communication with both the second output fuel path and the main pressure relief fuel path. The first and the second relief fuel paths are configured to restrict fuel flow therethrough between the first and the second output fuel paths.

The present teachings also provide for a fuel delivery system including a high pressure fuel pump assembly. The assembly includes a fuel pump chamber and a main fuel path in communication with the fuel pump chamber. A first output fuel path is in communication with the main fuel path and includes a first valve. A second output fuel path is in communication with the main fuel path and includes a second valve. A main pressure relief fuel path is in communication with the fuel pump chamber and includes a main relief valve. A first relief fuel path is in communication with both the first output fuel path and the main pressure relief fuel path. The first relief fuel path includes a first relief valve. The second relief fuel path is in communication with both the second output fuel path and the main pressure relief fuel path. The second relief fuel path includes a second relief valve. The first relief valve restricts fuel from flowing from the first output fuel path to the second output fuel path. The second relief valve restricts fuel from flowing from the second output fuel path to the first output fuel path.

The present teachings further provide for a fuel delivery system including a fuel pump, a main fuel path, a first output fuel path, and a second output fuel path. The fuel pump is housed within a fuel pump chamber. The main fuel path is in communication with the fuel pump chamber. The first output fuel path is in communication with the main fuel path. The second output fuel path is in communication with the main fuel path. A first fuel rail is configured to receive fuel from the first output fuel path and deliver fuel to a plurality of first fuel injectors. The second fuel rail is configured to receive fuel from the second output fuel path and deliver fuel to a plurality of second fuel injectors. A main pressure relief fuel path is in communication with the fuel pump chamber and includes a pressure relief valve. A first relief fuel path is in communication with both the first output fuel path and the main pressure relief fuel path. A second relief fuel path is in communication with both the second output fuel path and the main pressure relief fuel path. The first and the second relief fuel paths each provide an individual fuel path between the first and the second output fuel paths respectively. The main pressure relief fuel path includes the pressure relief valve. The first relief fuel path restricts fuel flow therethrough to the first output fuel path. The second relief fuel path restricts fuel flow therethrough to the second output fuel path.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings.

Figure 1:
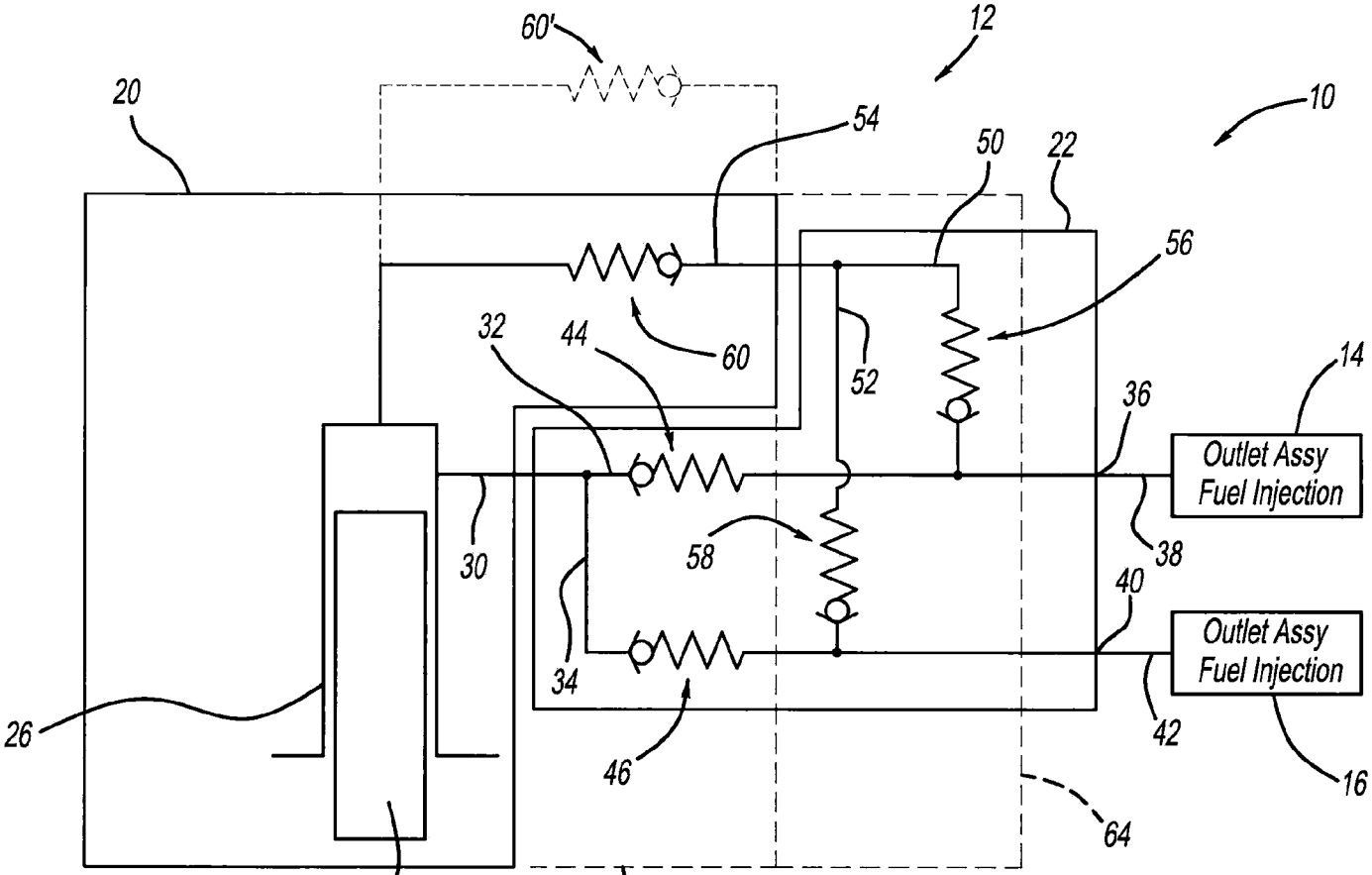
FIG. 1 is a schematic drawing of a fuel delivery system according to the present teachings.
Figure 2:
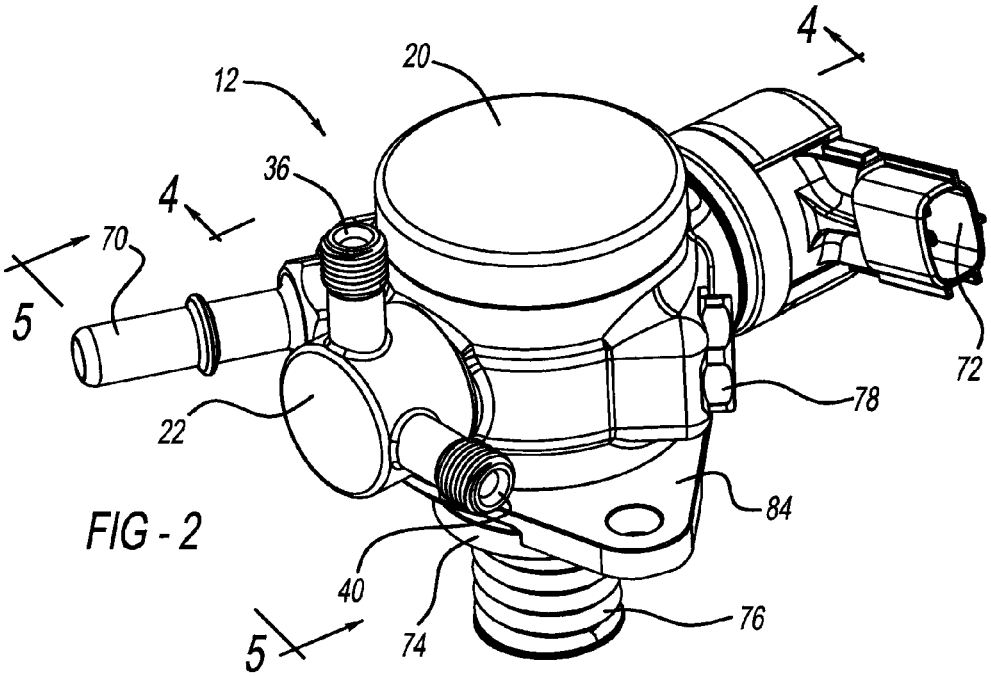
FIG. 2 is a perspective view of a high-pressure fuel pump assembly of the fuel delivery system of FIG. 1.

With initial reference to FIG. 1, a fuel delivery system according to the present teachings is generally illustrated at reference numeral 10. The fuel delivery system 10 is suitable to deliver fuel to most any suitable engine, such as a motor vehicle engine, a marine engine, or a military vehicle engine. The fuel delivery system 10 generally includes a high-pressure fuel pump assembly 12 for delivering fuel to at least a first bank of fuel injectors 14 and a second bank of fuel injectors 16, which subsequently delivery fuel to an engine. The high-pressure fuel pump assembly 12 generally includes a fuel pump housing 20 and an outlet assembly 22.

The fuel pump housing 20 generally includes a fuel pump plunger 24 within a fuel pump chamber 26. The fuel pump plunger 24 can be any type of suitable pump to pump fuel to the first and second banks of fuel injectors 14 and 16. Extending from the fuel pump chamber 26 is a main output fuel line or path 30, which as illustrated extends from the fuel pump chamber 26, via housing 20, to the outlet assembly 22 connected to the fuel pump housing 20. The main output fuel path 30 is thus defined by both the fuel pump housing 20 and the outlet assembly 22.

Extending from the main output fuel path 30 is a first output fuel path 32. Also extending from the main output fuel path 30 is a second output fuel path 34. The first and second output fuel paths 32 and 34 may be defined by the outlet assembly 22 as illustrated, and may be defined by the fuel pump housing 20 as well.

As illustrated, the first output fuel path 32 extends to a first output 36 of the outlet assembly 22, where the first output fuel path 32 connects to a first fuel rail 38, which delivers fuel to the first bank of fuel injectors 14. Similarly, the second output fuel path 34 extends to a second output 40 of the outlet assembly 22. At the second output 40, the second output fuel path 34 transitions to a second fuel rail 42, which delivers fuel to the second bank of fuel injectors 16.

The first output fuel path 32 includes a first check valve 44. The second output fuel path 34 includes a second check valve 46, which can be substantially similar to the first check valve 44. The first and second check valves 44 and 46 can each be any suitable type of valve or device to permit fuel, which has been pumped by the fuel pump plunger 24 from the fuel pump chamber 26, to pass therethrough once the fuel has reached a target fuel pressure, such as 10 PSI for example. The first and the second check valves 44 and 46 can be located in the outlet assembly 22 or included in a portion 62 of the fuel pump housing 20.

A first relief fuel path 50 extends from the first output fuel path 32, and a second relief fuel path 52 extends from the second output fuel path 34. Both the first and the second relief fuel paths 50 and 52 extend to a main pressure relief fuel path 54, which extends back to the fuel pump chamber 26. The first and the second relief fuel paths 50 and 52 can be defined by the outlet assembly 22 and may connect with the main pressure relief fuel path 54 at the outlet assembly 22 as illustrated. Alternatively, one or both of the first and the second relief fuel paths 50 and 52 may extend to the fuel pump housing 20 to connect to the main pressure relief fuel path 54 at the fuel pump housing 20.

The first relief fuel path 50 includes a first relief check valve 56 and the second relief fuel path 52 includes a second relief check valve 58. The main pressure relief fuel path 54 includes a pressure relief valve 60, which can be a high pressure relief valve. The first and second relief check valves 56 and 58 can be any suitable valve or device to permit passage of fuel from the first and second output fuel paths 32 and 34 respectively upon reaching a predetermined pressure, such as about 10 PSI, in order to relieve pressure in the first and second output fuel paths 32 and 34, as well as the first and second fuel rails 38 and 42.

The first and second relief check valves 56 and 58 are each configured to restrict fuel flow therethrough to the second and first output fuel paths 34 and 32 respectively. Therefore, fuel from the first output fuel path 32 that has passed through the first relief check valve 56 is prevented from flowing to the second output fuel path 34 by the second relief check valve 58 and the first check valve 44. Similarly, the first relief check valve 56 restricts fuel that has passed through the second relief check valve 58 from flowing to the first output fuel path 32. The first and second relief check valves 56 and 58 thus prevent "cross-talk," or fuel flow between the first and second banks of fuel injectors 14 and 16. The first and the second relief check valves 56 and 58 can be located in the outlet assembly 22 or included in a portion 64 of the fuel pump housing 20, regardless of where the first and the second check valves 44 and 46 are located.

The pressure relief valve 60 can be any suitable valve or device configured to permit fuel flow therethrough from the first or second relief fuel paths 50 and 52 once fuel has reached a predetermined pressure, such as 19 to 23 megapascals. The pressure relief valve 60 restricts fuel flow in the opposite direction. Fuel that has passed through the pressure relief valve 60 is returned to the fuel pump chamber 26 by way of the main pressure relief fuel path 54. The pressure relief valve 60 may be present in the fuel pump housing 20 as illustrated, or at any other suitable location, such as within the outlet assembly 22 or external to both the fuel pump housing 20 and the outlet assembly 22, as illustrated at reference number 60. The pressure relief valve 60 relieves pressure from the first and second fuel rails 38 and 42, and the first and the second relief check valves 56 and 58 prevent fuel from flowing between the first and second banks of fuel injectors 14 and 16.

Therefore, the first and second fuel rails 38 and 42, as well as the first and second banks of fuel injectors 14 and 16, are isolated such that fuel pressure pulses will not travel between the first and second fuel rails 38 and 42. There is no pressure differential between the first and second fuel rails 38 and 42, even when there are two injection events (or more) for one pumping event. This allows for the first and second fuel rails 38 and 42 to have a reduced volume, which can improve pressure rise times, reduce material costs, and improve reliability. The number of joints can also be reduced, because the fuel pump outlet assembly 22 acts as a T-joint.

Figure 4:
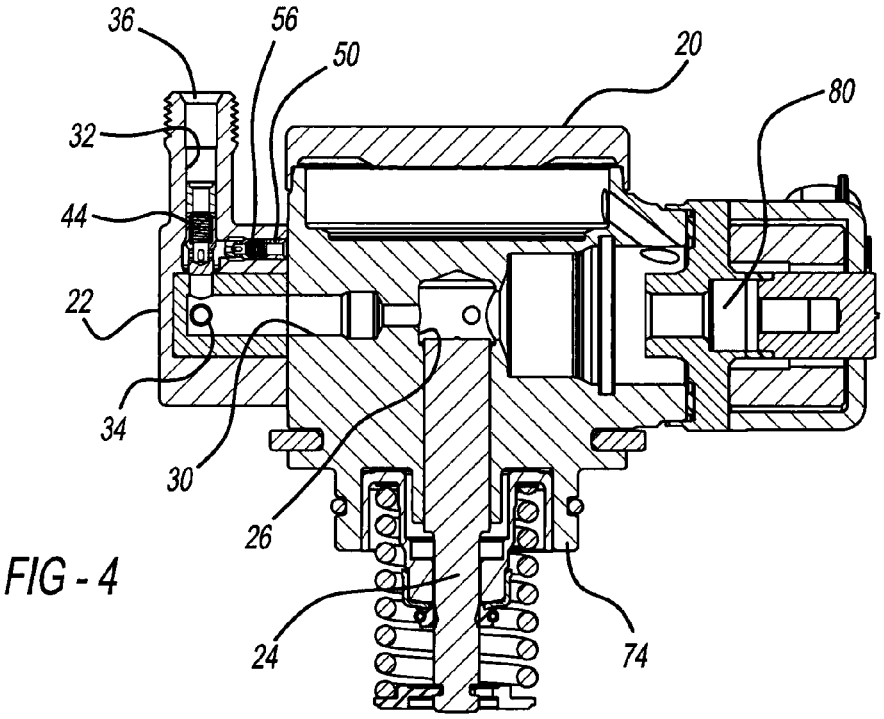
FIG. 4 is a cross-sectional view of the high-pressure fuel pump assembly of FIG. 2 taken along line 4-4 of FIG. 2.
Figure 3:
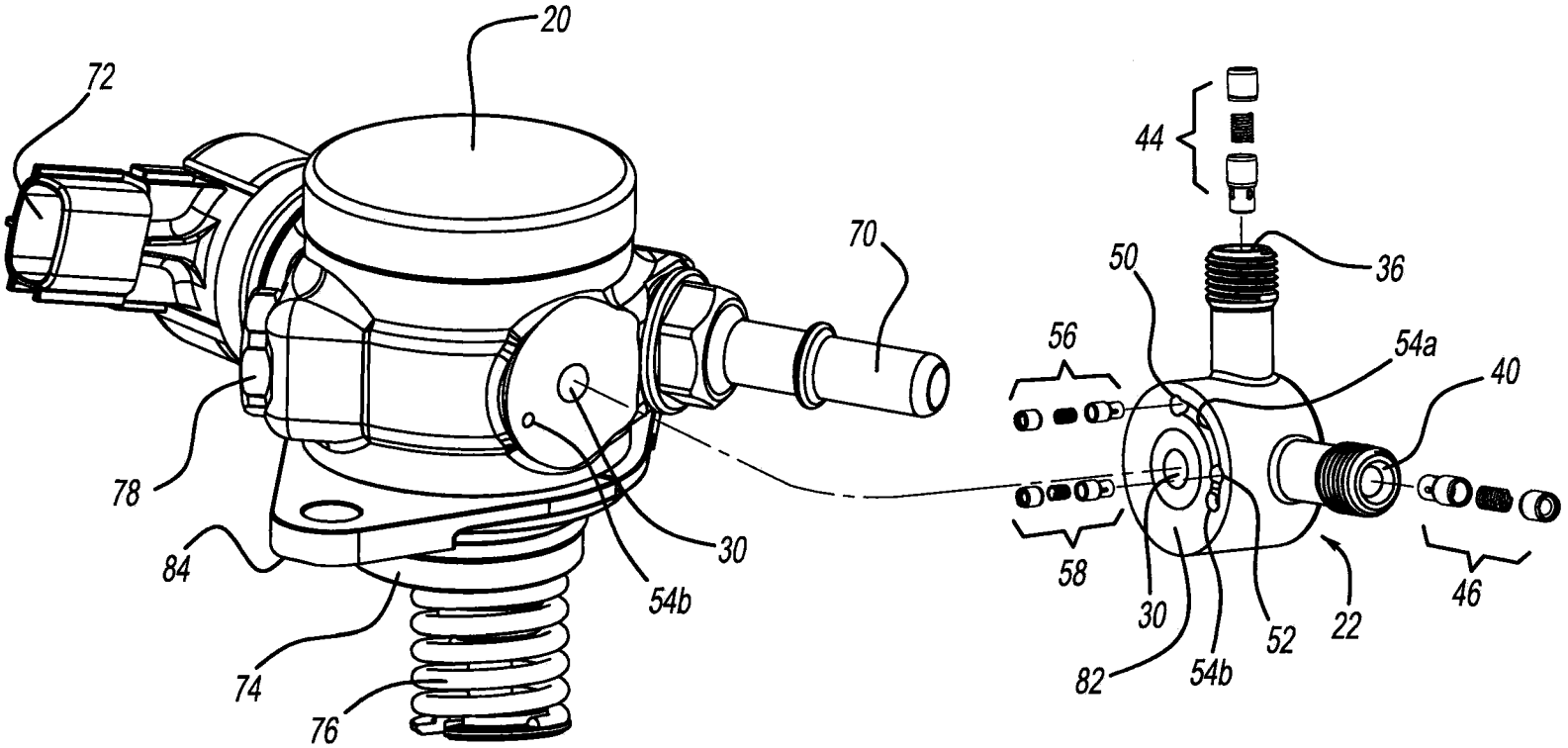
FIG. 3 is an exploded view of the high-pressure fuel pump assembly of FIG. 1 showing an outlet assembly separated from a fuel pump housing.
Figure 5:
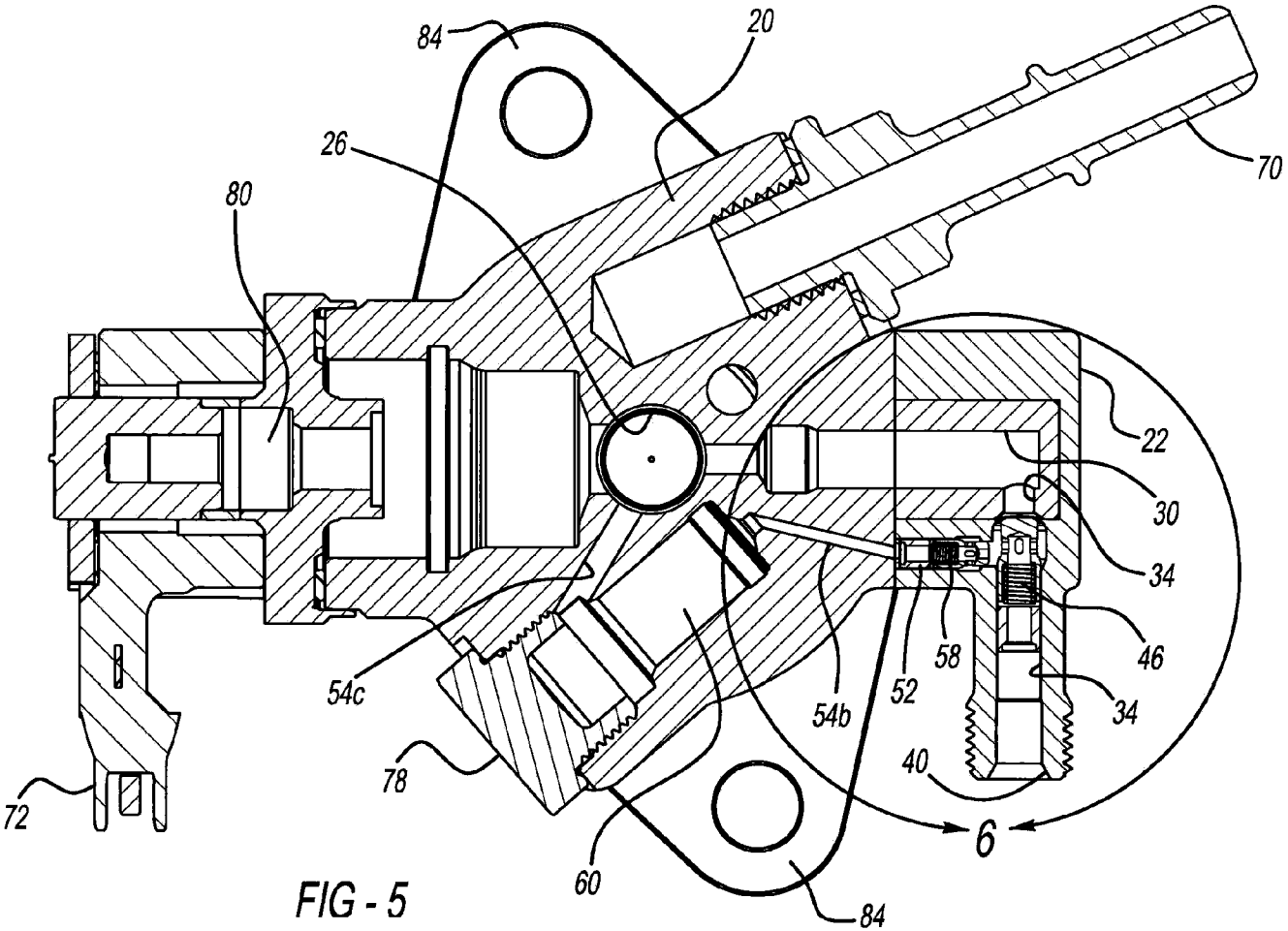
FIG. 5 is a cross-sectional view of the high-pressure fuel pump assembly of FIG. 2 taken along line 5-5 of FIG. 2.
Figure 6:
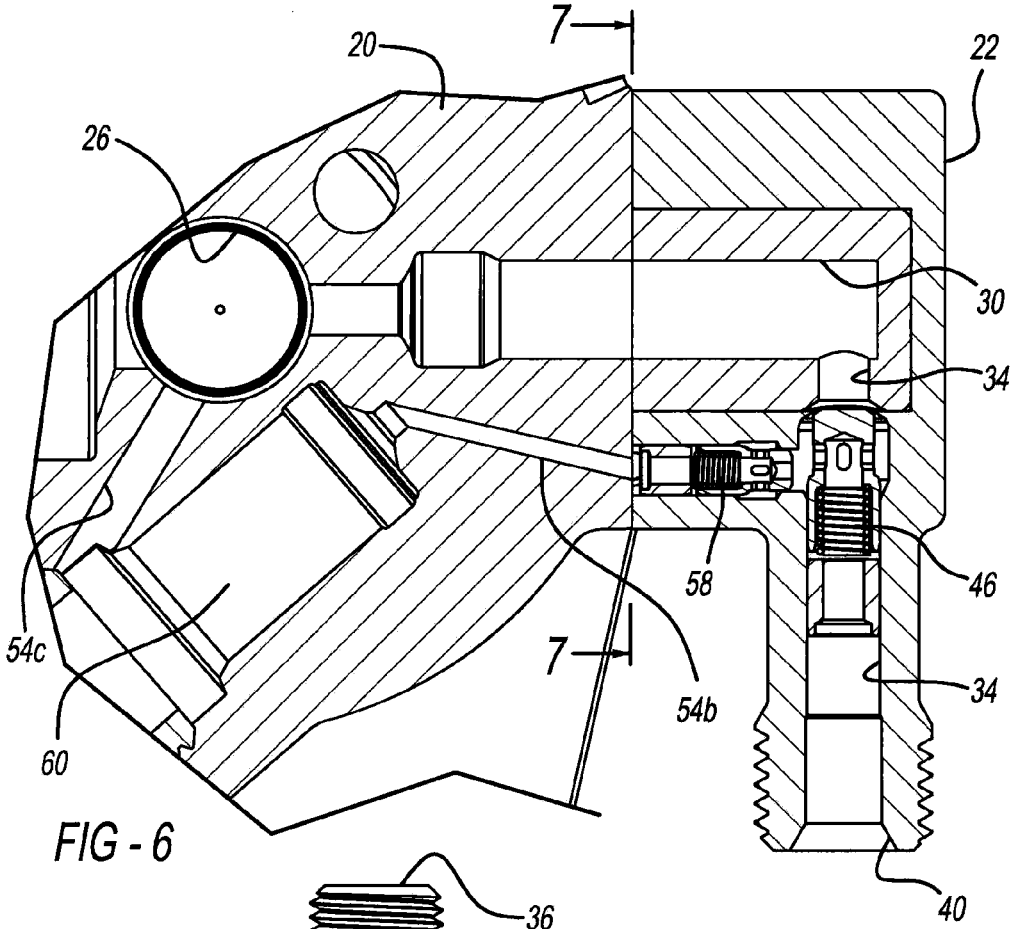
FIG. 6 is an enlarged view of area 6 of FIG. 5.
Figure 7:
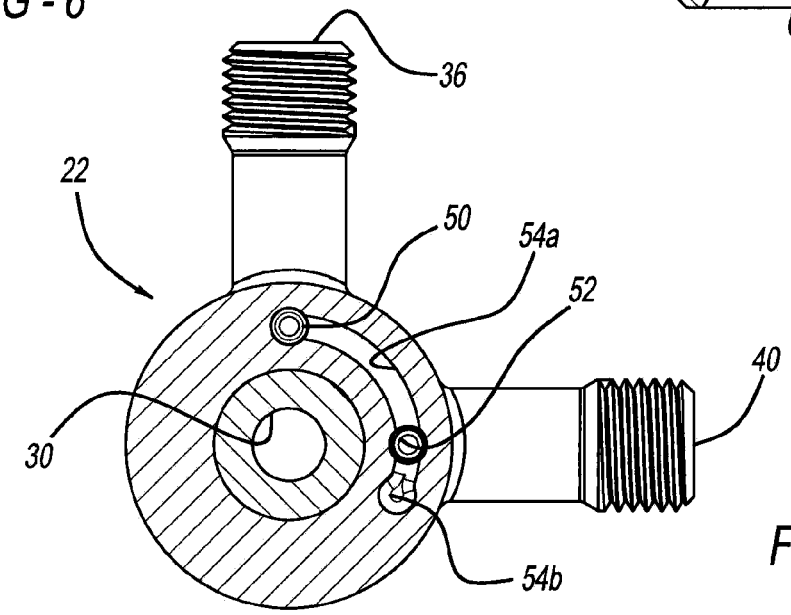
FIG. 7 is a cross-sectional view taken along line 7-7 of FIG. 6.

With additional reference to FIGS. 2-7, exemplary structural features of the high-pressure fuel pump assembly 12 will now be described. With initial reference to FIG. 2, the fuel pump housing 20 further includes a fuel inlet port 70, an electrical connector 72, a base 74, a resilient member 76, and a retention member 78. The fuel inlet port 70 is coupled to a fuel source and provides an inlet for fuel flow to the fuel pump chamber 26. The electrical connector 72 is configured to couple with any suitable current source to power the fuel pump plunger 24 and other components of the fuel pump housing 20, such as solenoid 80 (FIG. 4). Flange 84 is configured to mount the fuel pump housing 20 at any suitable location. Resilient member 76, which can take the form of a spring for example, is configured to ensure that the fuel pump plunger 24 remains in contact with an associated cam follower as the cam rises and falls at operating speeds. Retention member 78 secures the pressure relief valve 60 within the fuel pump housing 20.

With additional reference to FIGS. 3-7, the outlet assembly 22 can be a modular component, which can be affixed to the fuel pump housing 20 in any suitable manner. The main output fuel path 30 extends from the fuel pump housing 20 to the outlet assembly 22, where the first output fuel path 32 and the second output fuel path 34 extend therefrom at approximately a right angle relative to one another. The first check valve 44 is arranged in the first output fuel path 32 just downstream of where the first output fuel path 32 connects to the main output fuel path 30. Similarly, the second check valve 46 is just downstream of where the second output fuel path 34 connects to the main output fuel path 30. The first and second check valves 32 and 46 are thus also arranged at generally a right angle relative to one another.

The first relief fuel path 50 (FIGS. 3, 4, and 7 for example) extends from the first output fuel path 32 towards the fuel pump housing 20 at generally a right angle relative to the first output fuel path 32. The first relief check valve 56 is in the first relief fuel path 50, and thus extends generally parallel to the main output fuel path 30, which the first relief fuel path 50 is also parallel to. The second relief check valve 58 is seated in the second relief fuel path 52, each of which extend generally parallel to the main output fuel path 30 and towards the fuel pump housing 20. The first and second relief fuel paths 50 and 52, as well as the first and second relief check valves 56 and 58 seated therein, extend generally parallel to one another, but are spaced about 90° apart from one another.

The first and second relief fuel paths 50 and 52 are connected by the main pressure relief fuel path 54, and specifically a first portion 54*a* thereof. The first portion 54*a* is generally semicircular and is formed within an inner surface 82 of the outlet assembly 22, which is mounted against the fuel pump housing 20. The first portion 54*a* of the main pressure relief fuel path 54 extends to, and slightly beyond, the second relief fuel path 52. A second portion 54*b* of the main pressure relief fuel path 54 extends from the first portion 54*a* at generally a right angle relative thereto and into the fuel pump housing 20, where the second portion 54*b* is in communication with the pressure relief valve 60. A third portion 54*c* of the main pressure relief fuel path 54 extends from the pressure relief valve 60 to the fuel pump chamber 26.

An exemplary method and manner of operation of the fuel delivery system 10 will now be described. Upon activation of the fuel pump plunger 24, fuel delivered to the fuel pump chamber 26 by way of the fuel inlet port 70 is pumped out from within the fuel pump chamber 26 through the main output fuel path 30, and to the first and second output fuel paths 32 and 34. If the fuel pressure is above the predetermined fuel pressure required to open the first and second check valves 44 and 46, fuel will flow through the first and second check valves 44 and 46 to the first fuel rail 38 and the second fuel rail 42. From the first fuel rail 38 fuel flows to the first bank of fuel injectors 14, and from the second fuel rail 42 fuel flows to the second bank of fuel injectors 16. The first and second relief check valves 56 and 58 will remain open as long as the fuel pressure within the first and second output fuel paths 32 and 34 is substantially equal and above the predetermined pressure required to keep the first and second relief check valves 56 and 58 in the open position. The pressure relief valve 60 will remain closed as long as the fuel pressure within the first and second output fuel paths 32 and 34 and the first and second relief fuel paths 50 and 52 is below the predetermined threshold required to open the pressure relief valve 60.

If the fuel pressure within the first output fuel path 32 is sufficiently greater than the fuel pressure within the second output fuel path 34, the first check valve 44 will close, the first relief check valve 56 will remain open, and the pressure relief valve 60 may open (depends on pressure level) to allow fuel to pass therethrough and into the fuel pump chamber 26 by way of the main pressure relief fuel path 54. To prevent high-pressure fuel pulses from passing from the first and/or second relief fuel paths 50/54 to the second output fuel path 34, the second relief check valve 58 will close to prevent fuel from flowing therethrough to the second output fuel path 34. Closure of the second check valve 46 also restricts fuel from flowing to the second output fuel path 34 from the first output fuel path 32. With respect to the second check valve 46, it will remain open unless the fuel pressure therein is greater than the predetermined pressure required to close the second check valve 46.

If the fuel pressure of the second output fuel path 34 becomes sufficiently greater than the fuel pressure of the first output fuel path 32, the second relief check valve 58 will close to isolate the first bank of fuel injectors 14 from the second bank of fuel injectors 16. The second relief check valve 58 will open to provide a relieve path from the second output fuel path 34 to the main pressure relief fuel path 54. The pressure relief valve 60 may remain open (depends on pressure level) to permit highly pressurized fuel to pass from the second output fuel path 34 and the second bank of fuel injectors 16 back to the fuel pump chamber 26. The first check valve 44 will close to further isolate the first bank of fuel injectors 14 from the second bank of fuel injectors 16. The first check valve 44 will close if the fuel pressure within the first fuel rail 38 is greater than the fuel pressure of the main output fuel path 30.

Figure 8:
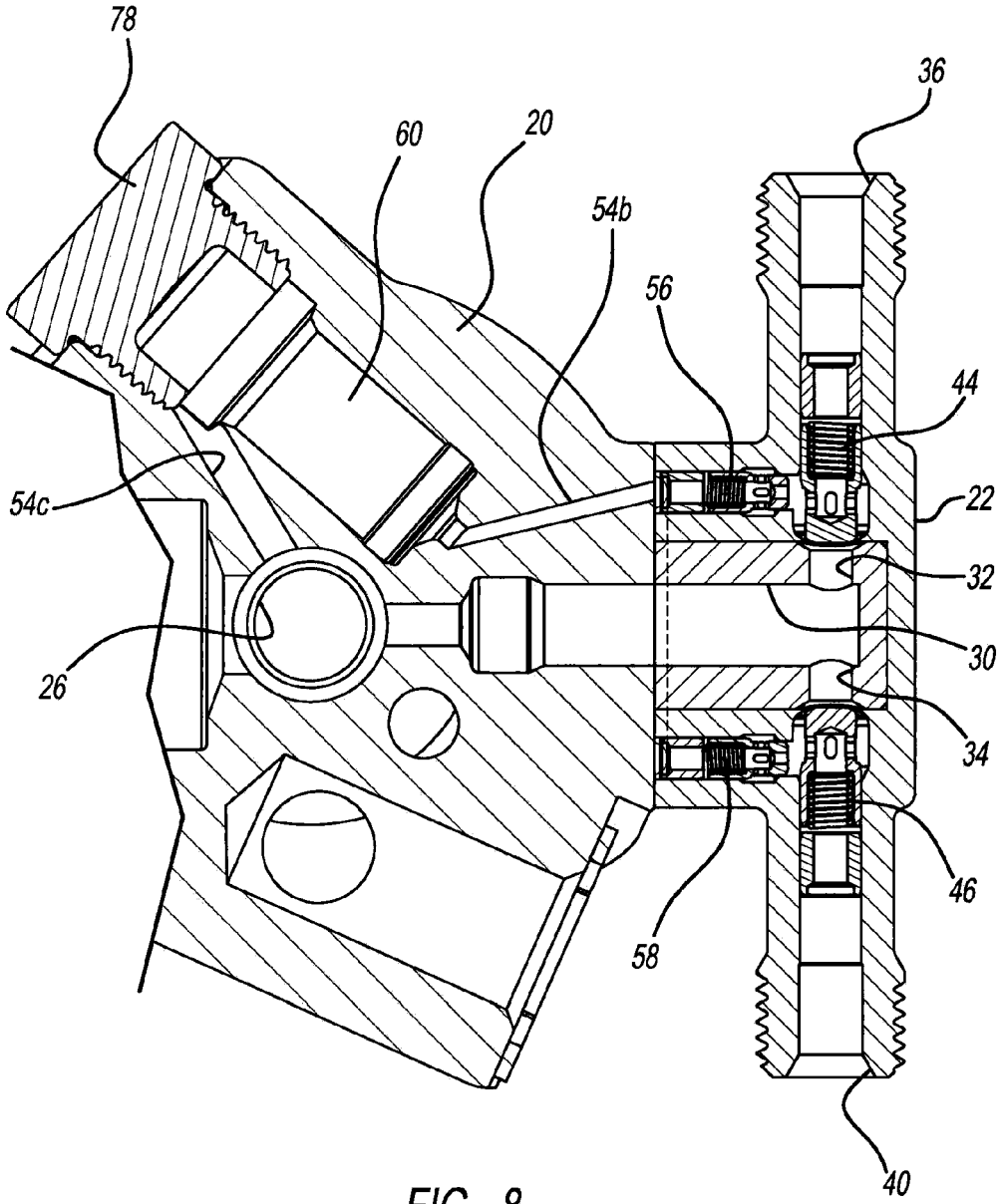
FIG. 8 is a cross-sectional view of another high-pressure fuel pump assembly according to the present teachings.

With additional reference to FIG. 8, an additional configuration of the outlet assembly 22 according to the present teachings is illustrated. In the configuration of FIG. 8, the first and second output fuel paths 32 and 34 are arranged at approximately 180° relative to one another, as opposed to the configuration of FIGS. 2-7 in which the first and second output fuel paths 32 and 34 are arranged at generally 98° relative to one another. The first portion 54*a* of the main pressure relief fuel path 54 thus extends approximately 180° between the first and second output fuel paths 32 and 34 in the configuration of FIG. 8. Other than these differences, the configuration of FIG. 8 is substantially similar to that of FIGS. 2-7.

Figure 9:
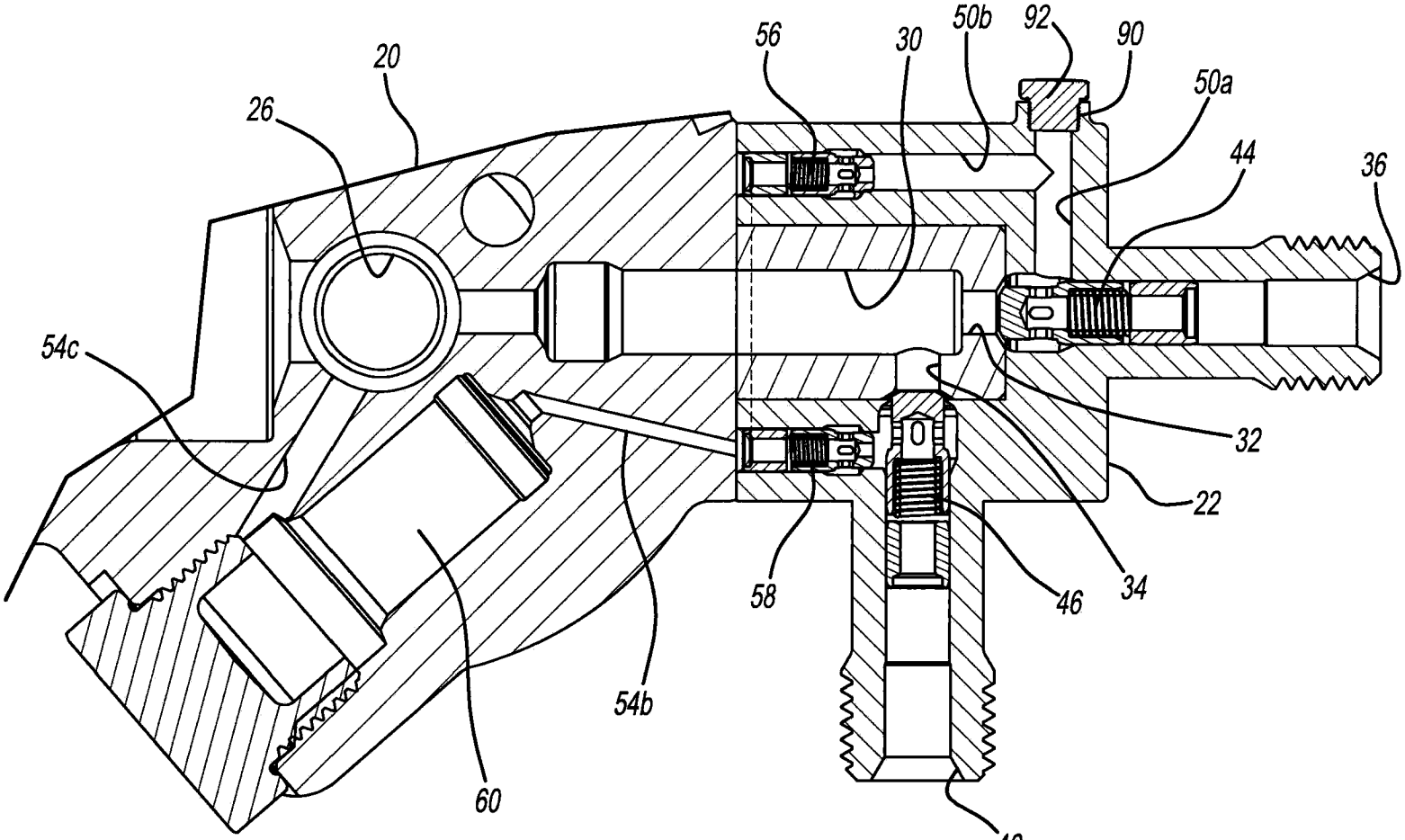
FIG. 9 is a cross-sectional view of yet another high-pressure fuel pump assembly according to the present teachings.

With additional reference to FIG. 9, yet another configuration of the outlet assembly 22 is illustrated. In this configuration, the first output fuel path 32 extends generally in line with the main output fuel path 30, and thus the first and second outputs 36 and 40 are arranged generally 90° relative to one another in the same plane. To accommodate this configuration, the first relief fuel path 50 includes a first portion 50*a* and a second portion 50*b*, which extend relatively 90° relative to one another. To facilitate providing the first and second portions 50*a* and 50*b* at a 90° angle relative to one another, the first portion 50*a* is formed by drilling or machining, for example, into the outlet assembly 22 from an outer surface thereof, thus forming an opening 90 sealed with a plug 92.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fuel delivery system including a high pressure fuel pump assembly comprising:

first and second output fuel paths each in communication with a fuel pump chamber;

a first check valve along the first output fuel path;

a second check valve along the second output fuel path;

a main pressure relief fuel path in communication with the fuel pump chamber and including a pressure relief valve;

a first relief fuel path in communication with both the first output fuel path and the main pressure relief fuel path;

a first relief valve along the first relief fuel path, the first relief valve configured to be closed to restrict fuel flow along the first relief fuel path;

a second relief fuel path in communication with both the second output fuel path and the main pressure relief fuel path; and a second relief valve along the second relief fuel path, the second relief valve configured to be closed to restrict fuel flow along the second relief fuel path;

wherein:

the first and the second relief fuel paths are configured to restrict fuel flow therethrough between the first and the second output fuel paths;

closing the first relief valve restricts fuel flow through the first relief fuel path; and closing the second relief valve restricts fuel flow through the second relief fuel path.

2. The fuel delivery system of claim 1, further comprising a fuel pump housing including the fuel pump and the pressure relief valve.

3. The fuel delivery system of claim 1, wherein the pressure relief valve is outside of a fuel pump housing including the fuel pump.

4. The fuel delivery system of claim 1, further comprising a fuel pump housing including the fuel pump and an outlet assembly coupled to the fuel pump housing, the outlet assembly including the pressure relief valve.

5. The fuel delivery system of claim 1, wherein the first relief valve is a first relief check valve and the second relief valve is a second relief check valve.

6. The fuel delivery system of claim 5, wherein the first and the second relief check valves are within an outlet assembly coupled to a fuel pump housing, the fuel pump housing including the fuel pump therein.

7. The fuel delivery system of claim 5, wherein the first and the second relief check valves are within a fuel pump housing that includes the fuel pump.

8. The fuel delivery system of claim 1, wherein the first output fuel path includes a first check valve and the second output fuel path includes a second check valve.

9. The fuel delivery system of claim 8, wherein the first and the second check valves are within an outlet assembly coupled to a fuel pump housing including the fuel pump.

10. The fuel delivery system of claim 8, wherein the first and the second check valves are within a fuel pump housing including the fuel pump.

11. A fuel delivery system including a high pressure fuel pump assembly comprising:

a fuel pump chamber;

a main fuel path in communication with the fuel pump chamber;

a first output fuel path in communication with the main fuel path;

a first check valve along the first output fuel path;

a second output fuel path in communication with the main fuel path;

a second check valve along the second output fuel path;

a main pressure relief fuel path in communication with the fuel pump chamber and including a main relief valve;

a first relief fuel path in communication with both the first output fuel path and the main pressure relief fuel path; and a first relief valve along the first relief fuel path, the first relief valve configured to be closed to restrict fuel flow along the first relief fuel path;

a second relief fuel path in communication with both the second output fuel path and the main pressure relief fuel path;

a second relief valve along the second relief fuel path, the second relief valve configured to be closed to restrict fuel flow along the second relief fuel path;

wherein:

the first relief valve restricts fuel from flowing from the first output fuel path to the second output fuel path;

the second relief valve restricts fuel from flowing from the second output fuel path to the first output fuel path;

closing the first relief valve restricts fuel flow through the first relief fuel path; and closing the second relief valve restricts fuel flow through the second relief fuel path.

12. The fuel delivery system of claim 11, wherein one or more of the first relief valve and the second relief valve are check valves.

13. The fuel delivery system of claim 11, further comprising a fuel pump housing including the fuel pump chamber and the main relief valve.

14. The fuel delivery system of claim 11, further comprising a fuel pump housing including the fuel pump chamber, the main relief valve is external to the fuel pump housing.

15. The fuel delivery system of claim 11, further comprising a fuel pump housing including the fuel pump chamber, and an outlet assembly coupled to the fuel pump housing, the outlet assembly including the first valve and the second valve.

16. The fuel delivery system of claim 11, further comprising a fuel pump housing including the fuel pump chamber, the first valve, and the second valve.

17. The fuel delivery system of claim 11, further comprising a first fuel rail configured to receive fuel pumped through the first output fuel path, a second fuel rail configured to receive fuel pumped through the second output fuel path, and high pressure lines that connect the high pressure fuel pump assembly to the first and the second fuel rails.

18. The fuel delivery system of claim 11, wherein the first fuel rail is configured to deliver fuel to a first bank of fuel injectors, and the second fuel rail is configured to deliver fuel to a second bank of fuel injectors.

19. A fuel delivery system comprising:

a fuel pump housed within a fuel pump chamber;

a main fuel path in communication with the fuel pump chamber;

a first output fuel path in communication with the main fuel path;

a first check valve along the first output fuel path;

a second output fuel path in communication with the main fuel path;

a second check valve along the second output fuel path;

a first fuel rail configured to receive fuel from the first output fuel path and deliver fuel to a plurality of first fuel injectors;

a second fuel rail configured to receive fuel from the second output fuel path and deliver fuel to a plurality of second fuel injectors;

a main pressure relief fuel path in communication with the fuel pump chamber and including a pressure relief valve;

a first relief fuel path in communication with both the first output fuel path and the main pressure relief fuel path;

a first relief valve along the first relief fuel path, the first relief valve configured to be closed to restrict fuel flow along the first relief fuel path;

a second relief fuel path in communication with both the second output fuel path and the main pressure relief fuel path; and a second relief valve along the second relief fuel path, the second relief valve configured to be closed to restrict fuel flow along the second relief fuel path;

wherein:

the first and the second relief fuel paths each provide an individual fuel path between the first and the second output fuel paths respectively, and the main pressure relief fuel path including the pressure relief valve;

the first relief fuel path restricts fuel flow therethrough to the first output fuel path when the first relief valve is closed; and the second relief fuel path restricts fuel flow therethrough to the second output fuel path when the second relief valve is closed.

20. The fuel delivery system of claim 19, wherein the first relief valve is a first relief check valve and the second relief valve is a second relief check valve.

* * * * *